US009055827B2

(12) United States Patent
Kobe et al.

(10) Patent No.: US 9,055,827 B2
(45) Date of Patent: Jun. 16, 2015

(54) MOUNTED DISPLAY CASE

(71) Applicant: HEARTS ON FIRE COMPANY, LLC, Boston, MA (US)

(72) Inventors: Tim Kobe, Singapore (SG); Hilary Clark, New York, NY (US); Mike Ely, Berkeley, CA (US); Lucinda Tay, San Francisco, CA (US); David Herman, San Francisco, CA (US); Sheldon Baker, Brooklyn, NY (US); Isao Takezawa, Fuchu (JP); Gideon Hillman, Sausalito, CA (US); Angela Wisco, San Francisco, CA (US)

(73) Assignee: Hearts On Fire Company, LLC, Boston, MA (US)

( * ) Notice: Subject to any disclaimer, the term of this patent is extended or adjusted under 35 U.S.C. 154(b) by 144 days.

(21) Appl. No.: 13/723,466

(22) Filed: Dec. 21, 2012

(65) Prior Publication Data

US 2013/0181583 A1 Jul. 18, 2013

Related U.S. Application Data

(60) Provisional application No. 61/581,415, filed on Dec. 29, 2011.

(51) Int. Cl.

| | |
|---|---|
| ***A47F 3/06*** | (2006.01) |
| ***A47B 46/00*** | (2006.01) |
| *A47F 7/02* | (2006.01) |

(52) U.S. Cl.

CPC ..... *A47F 3/06* (2013.01); *A47B 46/005* (2013.01); *A47F 3/063* (2013.01); *A47F 7/02* (2013.01)

(58) Field of Classification Search

CPC ..... A47B 46/005; A47B 51/00; A47B 88/06; A47F 3/06; A47F 7/02

USPC ..... 312/114, 119, 120, 122, 123, 138.1, 312/245, 246, 247, 248, 204, 301

See application file for complete search history.

(56) References Cited

U.S. PATENT DOCUMENTS

| | | | | | |
|---|---|---|---|---|---|
| 1,380,161 | A | * | 5/1921 | Sherer | 312/119 |
| 1,425,259 | A | * | 8/1922 | Howe | 312/213 |
| 2,471,529 | A | * | 5/1949 | La Barre | 312/303 |
| 2,506,086 | A | * | 5/1950 | Jess | 312/247 |
| 2,567,630 | A | * | 9/1951 | Whittier et al. | 5/308 |

(Continued)

FOREIGN PATENT DOCUMENTS

| | | |
|---|---|---|
| EP | 2327337 | 6/2011 |
| JP | 2004-127466 | 4/2004 |
| WO | WO 99/49757 | 10/1999 |

OTHER PUBLICATIONS

Internation Search Report mailed Apr. 22, 2013 issued in International Patent Application No. PCT/US2012/071152.

(Continued)

*Primary Examiner* — James O Hansen

(74) *Attorney, Agent, or Firm* — DLA Piper LLP (US)

(57) ABSTRACT

Display cases are designed to be mounted on at least one vertical support, such as a wall, pillar, or series of poles. The display cases include a display drawer that has a closed position within the display case and an open position beneath the display case. The display cases can be single sided, having a display drawer only on its front side, or double sided, having a first display drawer on its front side and a second display drawer on its rear side.

21 Claims, 13 Drawing Sheets

(56) References Cited

U.S. PATENT DOCUMENTS

| | | | | | |
|---|---|---|---|---|---|
| 2,839,349 | A | * | 6/1958 | Culver | 312/323 |
| 3,250,584 | A | * | 5/1966 | Tassell | 312/247 |
| 3,489,474 | A | * | 1/1970 | Patriarca | 312/119 |
| 3,694,046 | A | * | 9/1972 | Gehrmann | 312/196 |
| 4,184,725 | A | * | 1/1980 | Spangler | 312/233 |
| 4,230,066 | A | * | 10/1980 | Lents | 118/20 |
| 4,285,557 | A | * | 8/1981 | Paladino et al. | 312/246 |
| 4,915,461 | A | * | 4/1990 | Kingsborough et al. | 312/247 |
| 6,336,692 | B1 | | 1/2002 | Snyder | |
| 6,676,232 | B2 | | 1/2004 | Fulop | |
| 7,040,724 | B2 | * | 5/2006 | Kelley et al. | 312/205 |
| 7,249,812 | B2 | | 7/2007 | Fulop | |
| 7,584,119 | B2 | | 9/2009 | Armstrong | |
| 8,280,775 | B2 | | 10/2012 | Armstrong | |
| 8,303,050 | B2 | | 11/2012 | Hahn | |
| 2003/0184192 | A1 | | 10/2003 | Fulop | |
| 2004/0036384 | A1 | | 2/2004 | Fulop | |
| 2007/0241650 | A1 | | 10/2007 | Schmitt | |
| 2007/0247034 | A1 | | 10/2007 | Fulop | |
| 2008/0235097 | A1 | | 9/2008 | Armstrong | |
| 2008/0235099 | A1 | | 9/2008 | Armstrong | |
| 2008/0235100 | A1 | | 9/2008 | Armstrong | |
| 2009/0319381 | A1 | | 12/2009 | Armstrong | |
| 2010/0127603 | A1 | | 5/2010 | Hahn | |
| 2011/0266936 | A1 | * | 11/2011 | Moran | 312/312 |
| 2011/0266937 | A1 | | 11/2011 | Roberts et al. | |

OTHER PUBLICATIONS

Written Opinion of International Search Authority mailed Apr. 22, 2013 issued in International Patent Application No. PCT/US2012/071152.

English language abstract for JP 2004-127466 published on Apr. 22, 2004.

English language translation for JP 2004-127466 published on Apr. 22, 2004.

Singaporean Office Action issued in Patent Application No. 11201403643U dated Apr. 17, 2015.

* cited by examiner

MOUNTED DISPLAY CASE

CROSS-REFERENCE TO RELATED APPLICATIONS

This application is based on and derives the benefit of the filing date of U.S. Provisional Patent Application No. 61/581,415, filed Dec. 29, 2011. The entire content of this application is herein incorporated by reference in its entirety.

FIELD OF THE INVENTION

The present technology relates to display cases for displaying merchandise, and particularly to display cases that can be mounted on a vertical support

DESCRIPTION OF RELATED ART

Display cases for displaying retail merchandise typically sit on the floor and include at least one clear display window through which a customer can view the merchandise displayed within the case, creating a counter where a store employee is on one side of the display case and the customer on the opposite side. Such display cases normally have a lockable sliding back panel that can be opened by the employee, who can then reach into the display case to either stock the case or remove merchandise for inspection by a customer.

SUMMARY OF THE INVENTION

The present technology relates to display cases that can be mounted on a vertical support.

In one aspect, display cases are provided that include a frame having a top and a plurality of sidewalls, the frame housing a first display area, as well as a front viewing pane attached to the top and the sidewalls. There can be a first display area that is enclosed by the frame, which is visible through the front viewing pane. A first display drawer can be slidably connected to the frame, and can have a closed position and an open position, wherein the first display drawer is enclosed within the first display area in the closed position and is extended beneath the first display area in the open position. The display case can also include a first locking mechanism that locks the first display drawer in the closed position.

In some examples, a display case may also include a rear viewing pane attached to the frame, wherein a second display area enclosed by the frame is visible through the rear viewing pane. Such examples can include a second display drawer slidably connected to the frame, the second display drawer having a closed position and an open position, wherein the second- display drawer is enclosed within the second display area in the closed position and is extended beneath the second display area in the open position. There can also be a second locking mechanism that locks the second display drawer in the closed position.

Further, in some examples, the display drawer can include a display face having a left side and a right side, a side plate connected to each side of the display face, and a support arm connected to each side plate at an angle of less than about 180°. In such examples, each support arm can be slidably connected to a vertical track secured to a sidewall of the display case.

BRIEF DESCRIPTION OF THE DRAWINGS

Specific examples have been chosen for purposes of illustration and description, and are shown in the accompanying drawings, forming a part of the specification.

DETAILED DESCRIPTION

Figure 1:
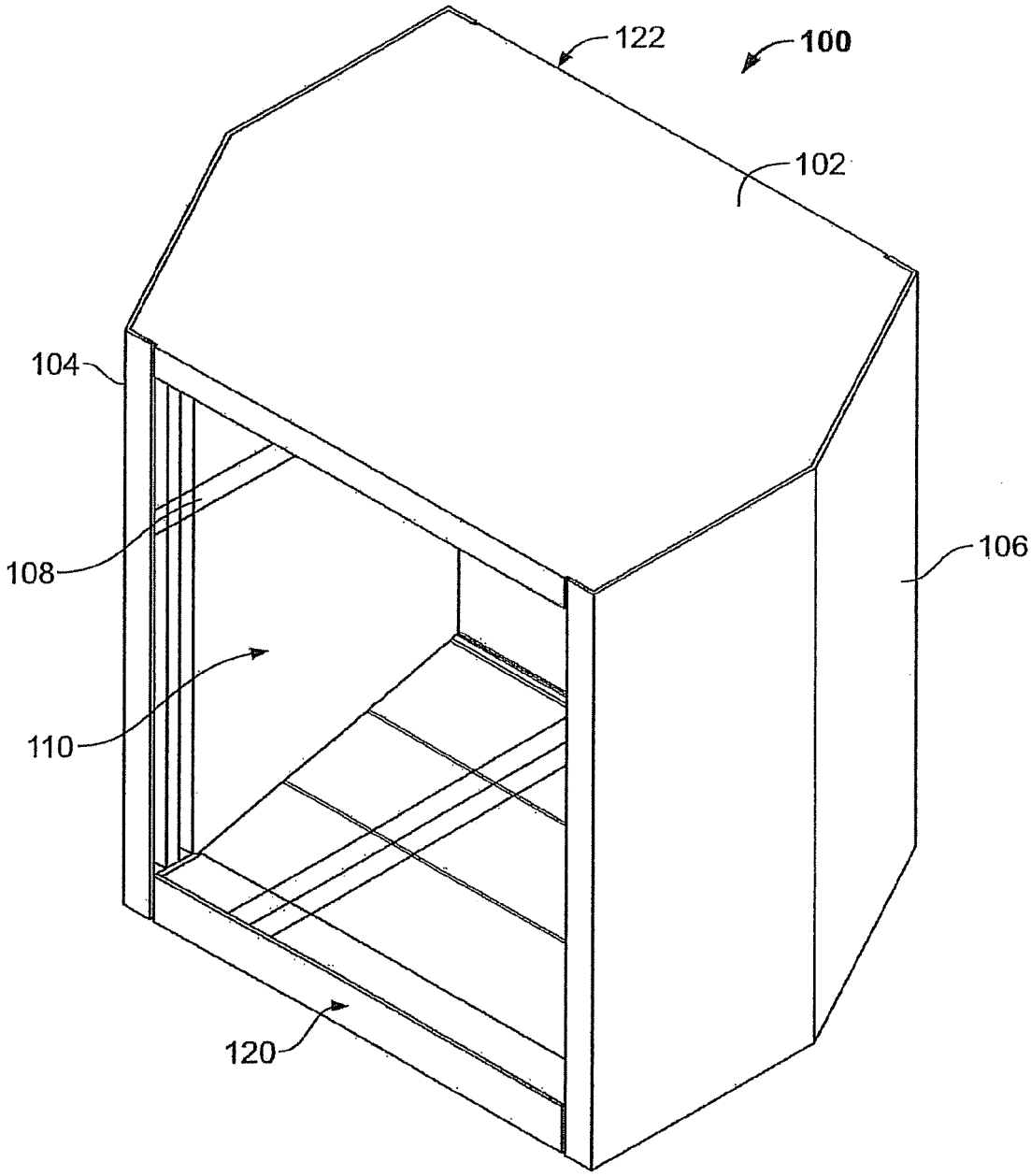
FIG. 1 is a perspective view of one example of a display case of the present technology.

Display cases of the present technology can be mounted on a vertical support, such as a wall, or one or more pillars. Display cases of the present technology include at least one display drawer, into which interchangeable display panels may be placed to display various types of merchandise, including but not limited to jewelry. Some examples of display cases of the present technology is illustrated in FIGS. 1-9. Some examples of display panels for use in such display cases are illustrated in FIGS. 10-14.

As illustrated in the examples shown in FIGS. 1, 2A, and 3-9 the exterior of a display case 100 of the present technology can include a frame having a top 102 and a plurality of sidewalls, such as a left side wall 104, a right sidewall 106. A display case 100 of the present technology can also include a front viewing pane 108. There can be a first display area 110 that is enclosed by the frame, which can be visible through the front viewing pane 108. The top 102 and side walls 104 and 106 can preferably be opaque, and can be made of any suitable material, including for example metal, such as stainless steel, wood, or plastic. The front viewing pane 108 can preferably be clear, so that consumers can look through the front viewing pane 108 at merchandise displayed within the display case 100. The front viewing pane 108 can be made of any suitable material, including for example, glass, plastic, or Plexiglas.

The display case has a case depth as measured from the front viewing pane 108 to the rear side 122 of the display case 100. The first display area 110 can have a depth that is preferably up to about half the case depth.

Figure 2A:
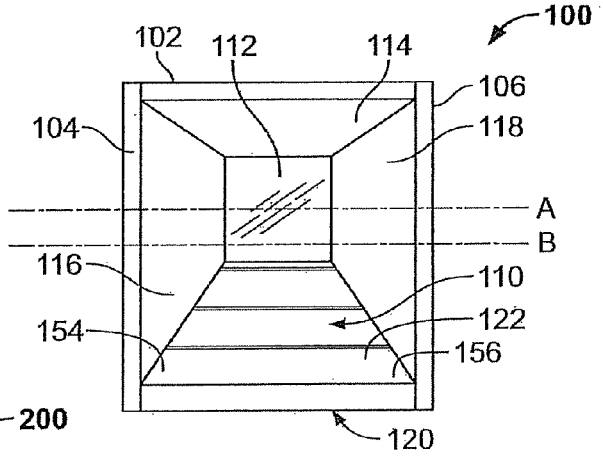
FIG. 2A is a front view of the display case of FIG. 1.
Figure 2B:
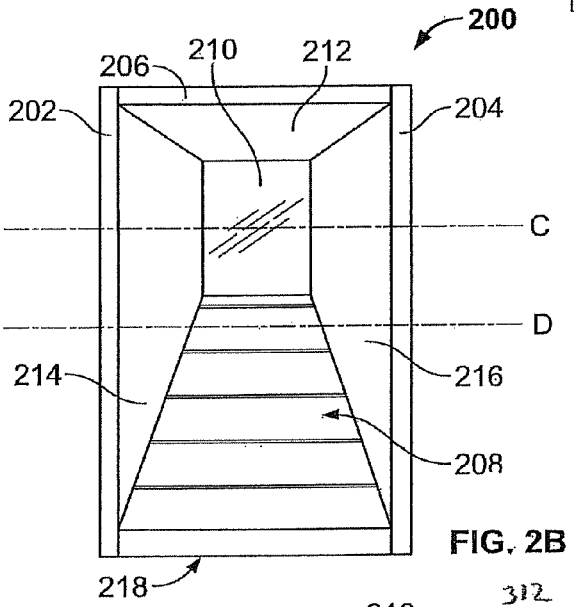
FIG. 2B is a front view of a second example of a display case of the present technology.
Figure 2C:
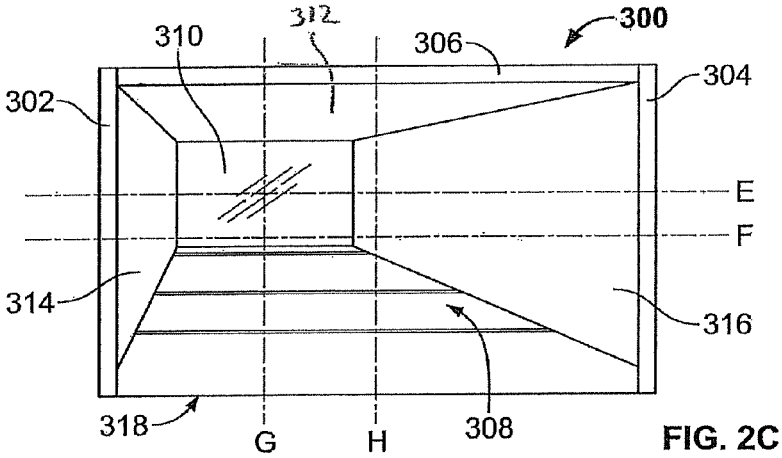
FIG. 2C is a front view of a third example of a display case of the present technology.

FIGS. 2A-2C show front views of various examples of display cases of the present technology, looking through the front viewing panel into a first display area of the cases.

Figure 9:
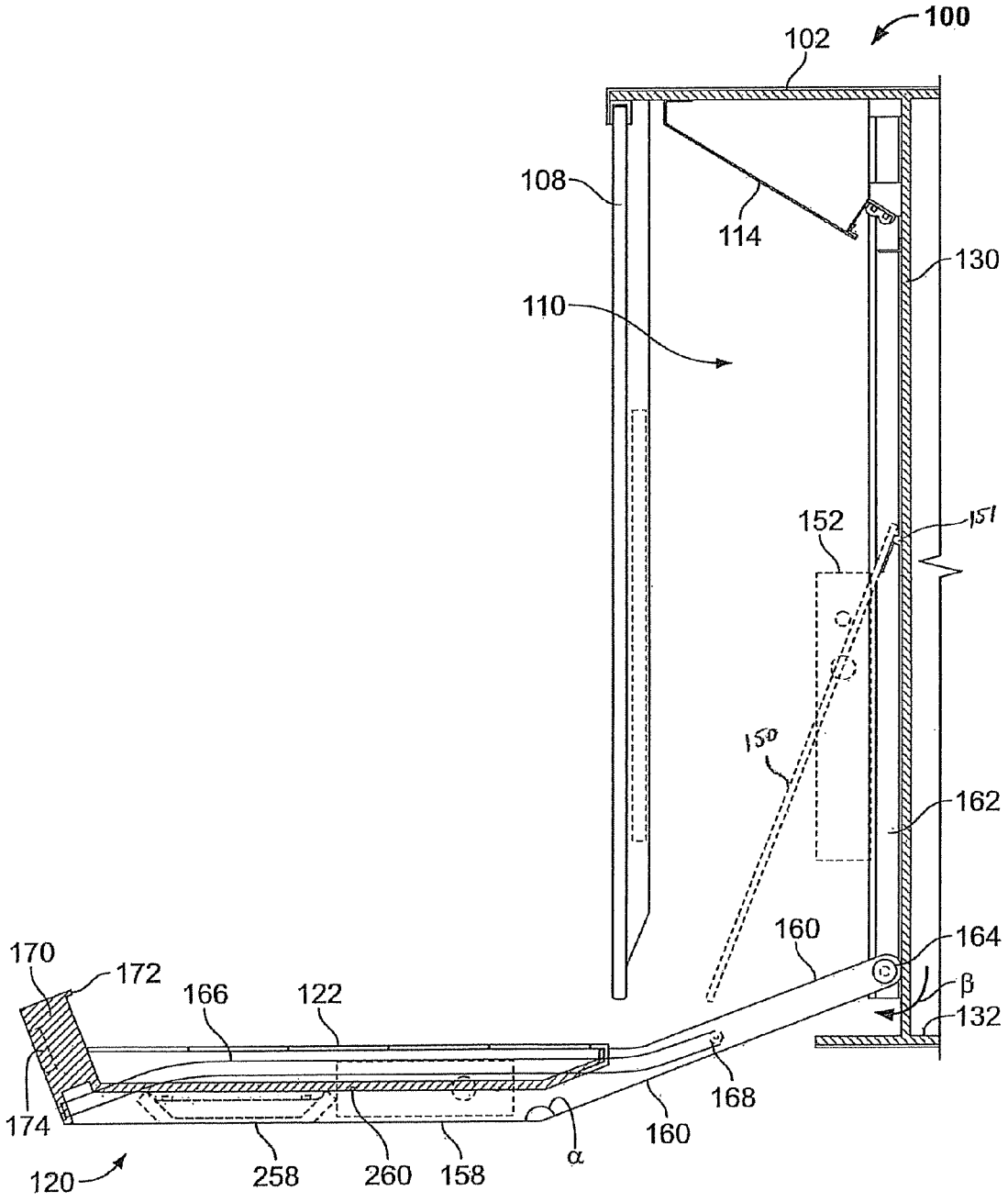
FIG. 9 is a side cross-sectional view of the display area of FIGS. 6-8, in an opened position.
Figure 10:
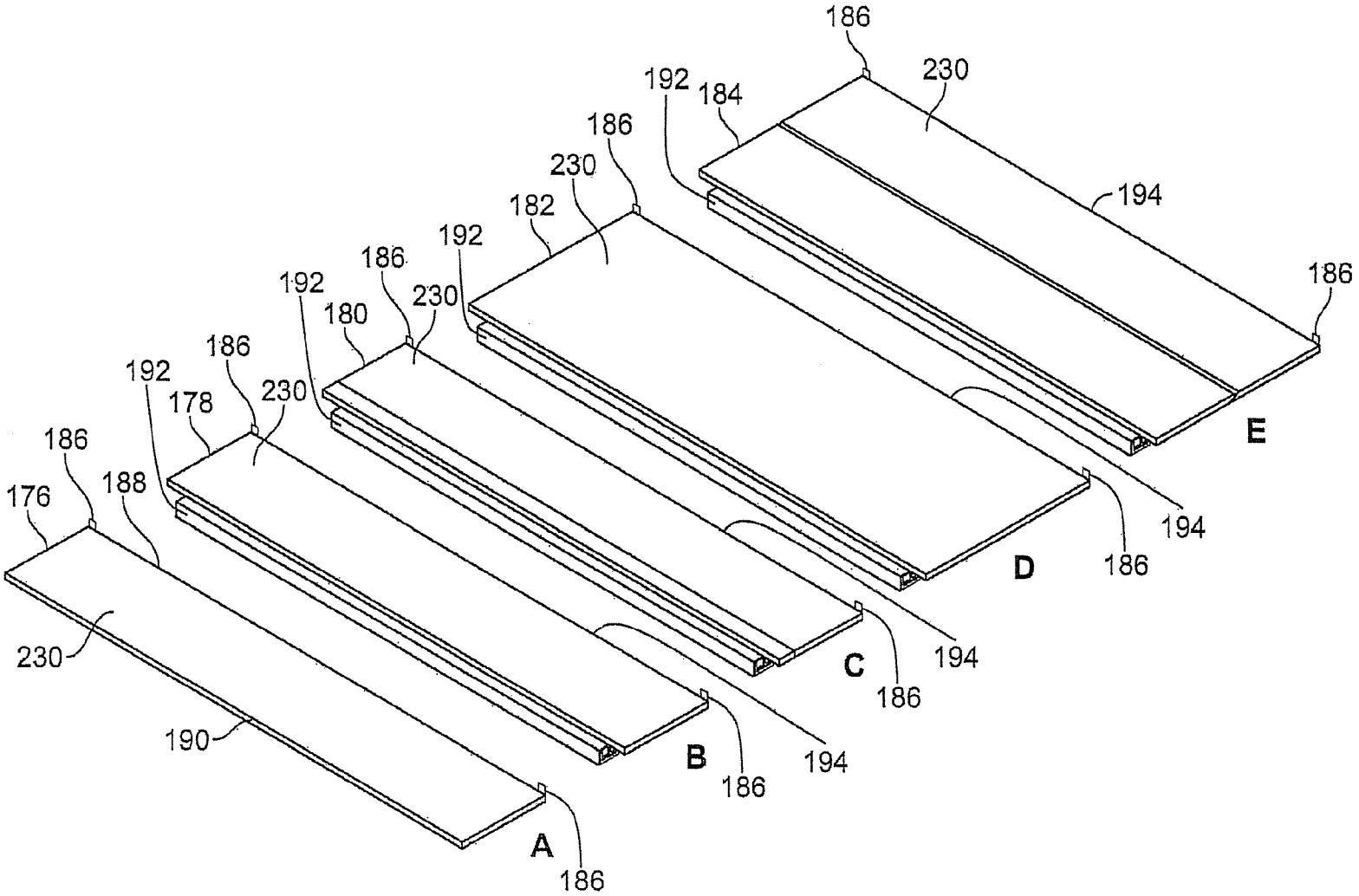
FIG. 10A is a perspective view of a first example of a display panel for use in a display case of the present technology.
FIG. 10B is a perspective view of a second example of a display panel for use in a display case of the present technology.
FIG. 10C is a perspective view of a third example of a display panel for use in a display case of the present technology.
FIG. 10D is a perspective view of a fourth example of a display panel for use in a display case of the present technology.
FIG. 10E is a perspective view of a fifth example of a display panel for use in a display case of the present technology.

The front of display case 100 as shown in FIG. 2A has a square shape. The first display area 110 includes a back panel 112, a top panel 114 attached to the top 102, a left side panel 116 attached to the left sidewall 104, a right side panel 118 attached to the right sidewall 106, and a first display drawer 120. The first display drawer 120, as discussed in further detail below, is configured to hold merchandise that can be viewed through the front viewing pane 108 of the display case 100. The first display drawer 120 can be. slidably connected to the sidewalls 104 and 106, and can have a closed position and an open position. In the closed position, the first display drawer 120 can be enclosed within the first display area 110, as shown in FIGS. 1 and 2A. In the open position, the first display drawer 120 can be extended beneath the first display area, as shown in FIG. 9.

As shown in FIG. 2A, the first display drawer 120 can have a display face 122 having a left side 154 and a right side 156, which is inclined from the back of the display area 110 at its top end to the front of the display area 110 at its bottom end when the first display drawer 120 is in the closed position. The back panel 112 is positioned in the display case at a desired height, and can be placed off-center, such as, for example, being placed vertically off-center such that a horizontal centerline A of the back panel 112 is above a horizontal centerline B of the display case 100. The display drawer 120, the top panel 114, the left side panel 116, and the right side panel 118 all slant inwardly from the outer edges of the display case 100 towards the back panel 112 at the back of the display area 110.

The front of display case 200 as shown in FIG. 2B is rectangular, with sidewalls 202 and 204 having a length that is greater than the length of the top 206. Like the first display area 110 of the display case 100 show in FIG. 2A, the first display area 208 of the display case 200 shown in FIG. 2B includes a back panel 210, a top panel 212 attached to the top 206, a left side panel 214 attached to the left sidewall 204, a right side panel 216 attached to the right sidewall 202, and a display drawer 218. The back panel 210 can be positioned in the display case at a desired height, and can be placed off-center, such as, for example, being placed vertically off-center such that a horizontal centerline C of the back panel 210 is above a horizontal centerline D of the display case 200. The display drawer 218, the top panel 212, the left side panel 214, and the right side panel 216 can all slant inwardly from the outer edges of the display case 200 towards the back panel 210 at the back of the display area 208.

The front of display case 300 as shown in FIG. 2C is rectangular, with sidewalls 302 and 304 having a length that is less than the length of the top 306. As with the display cases of FIGS. 2A and 2B, the first display area 308 of the display case 300 shown in FIG. 2C includes a back panel 310, a top panel 312 attached to the top 306, a left side panel 314 attached to the left sidewall 304, a right side panel 316 attached to the right sidewall 302, and a display drawer 318. The back panel 310 can be positioned in the display case at a desired height, and can be placed off-center. For example, the back panel 310 can be placed vertically off-center such that such that a horizontal centerline E of the back panel 310 is above a horizontal centerline F of the display case 300. The back panel 310 can also be positioned horizontally off-center, for example, as illustrated, such that a vertical centerline G of the back panel 310 is to the left Of a vertical centerline H of the display case 300. The display drawer 318, the top panel 312, the left side panel 314, and the right side panel 316 can all slant inwardly from the outer edges of the display case 300 towards the back panel 310 at the back of the display area 308.

Figure 3:
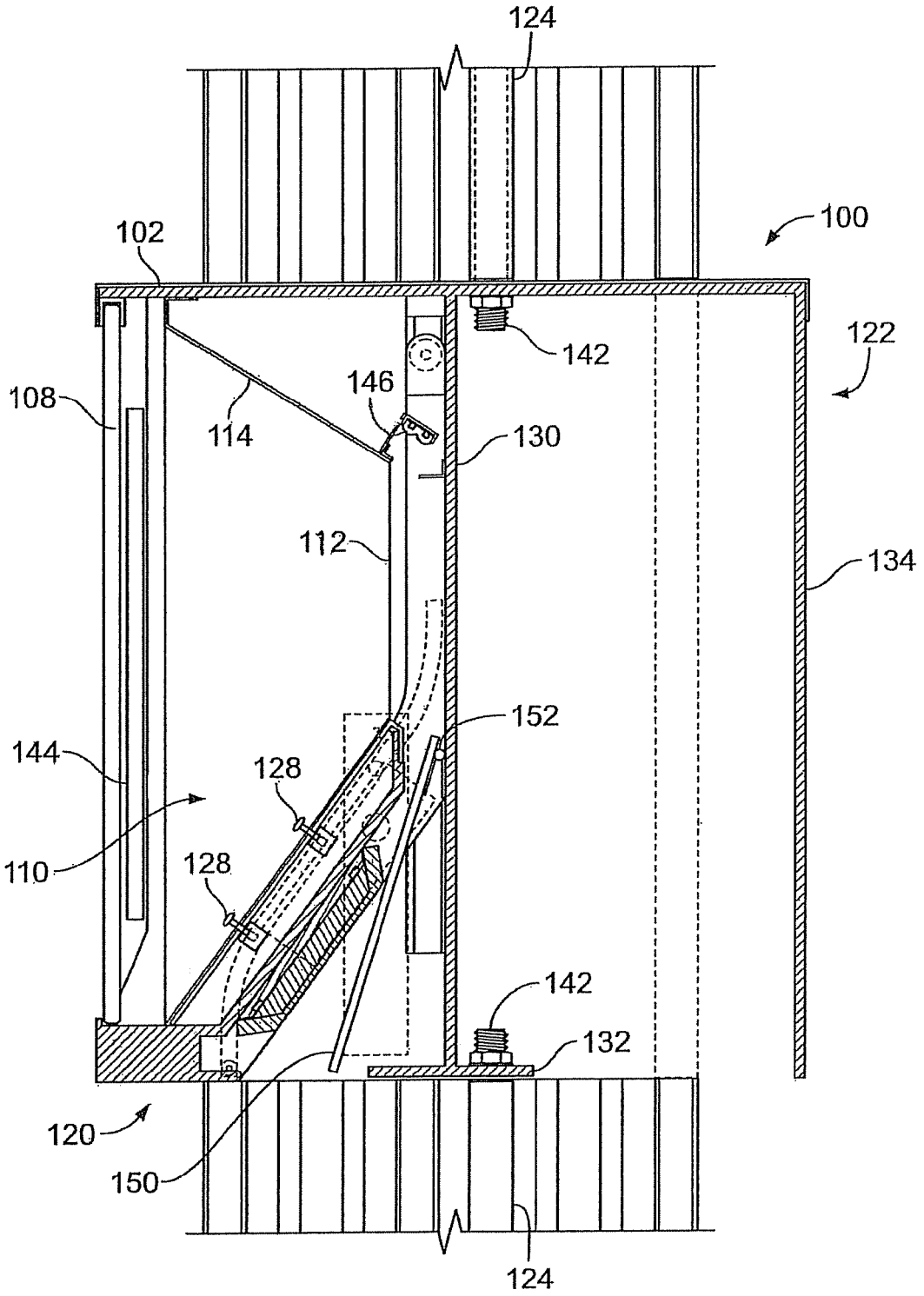
FIG. 3 is a side cross-sectional view of the display case of FIG. 1.
Figure 4:
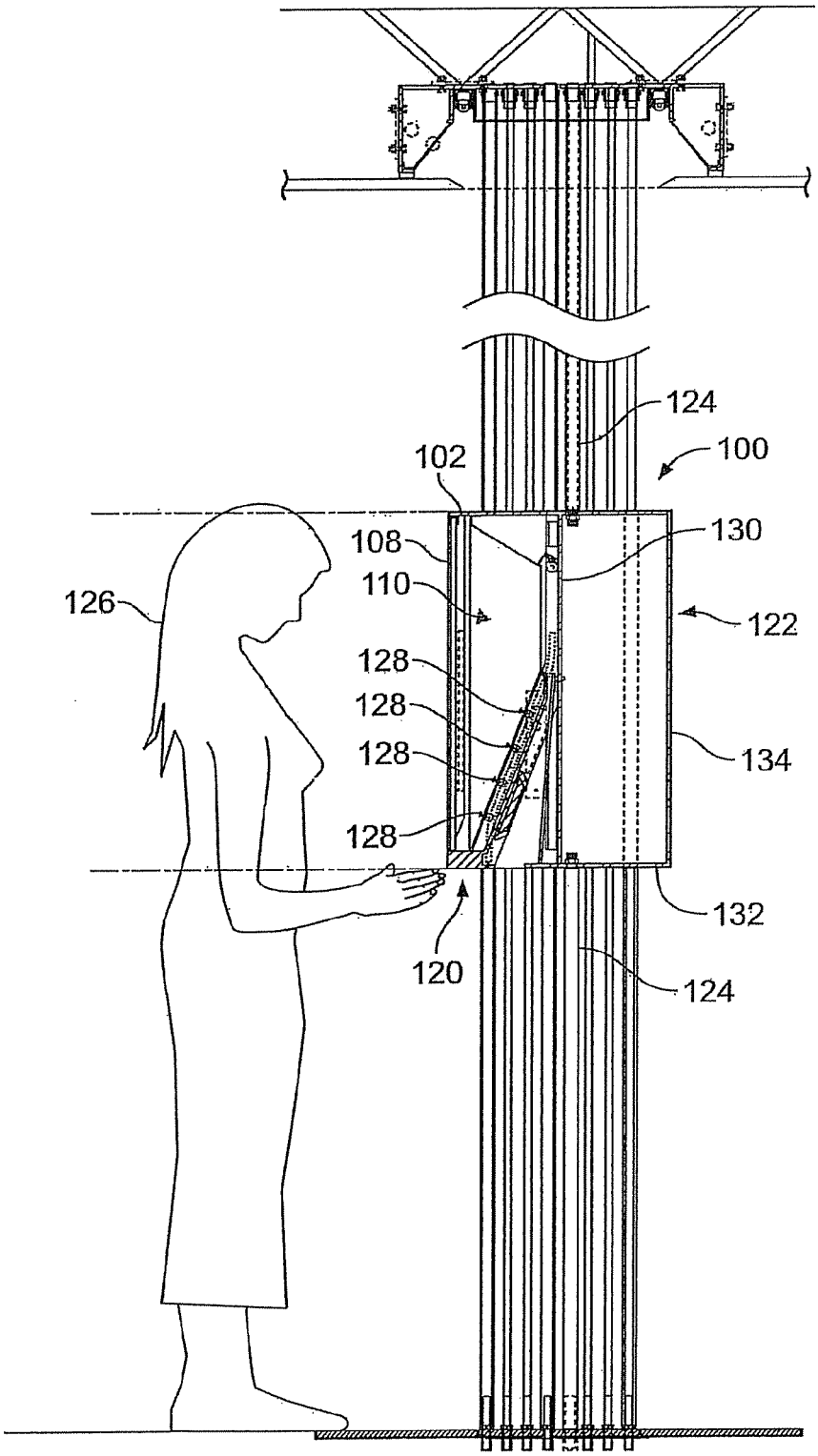
FIG. 4 is a side cross-sectional view of a single-sided display case of FIG. 1, mounted on a veil wall.
Figure 5:
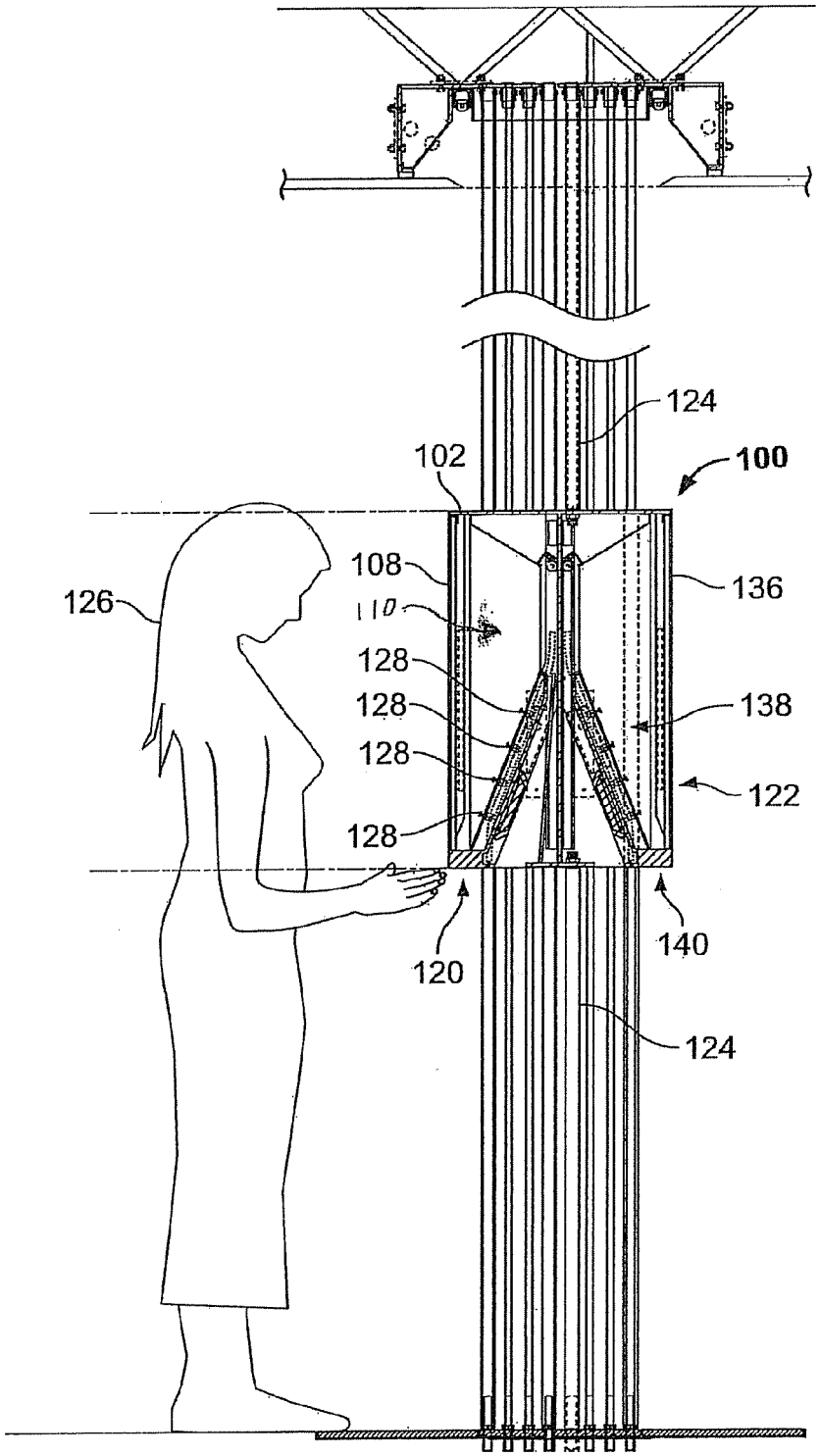
FIG. 5 is a side cross-sectional view of a double-sided display case of FIG. 1, mounted on a veil wall.
Figure 6:
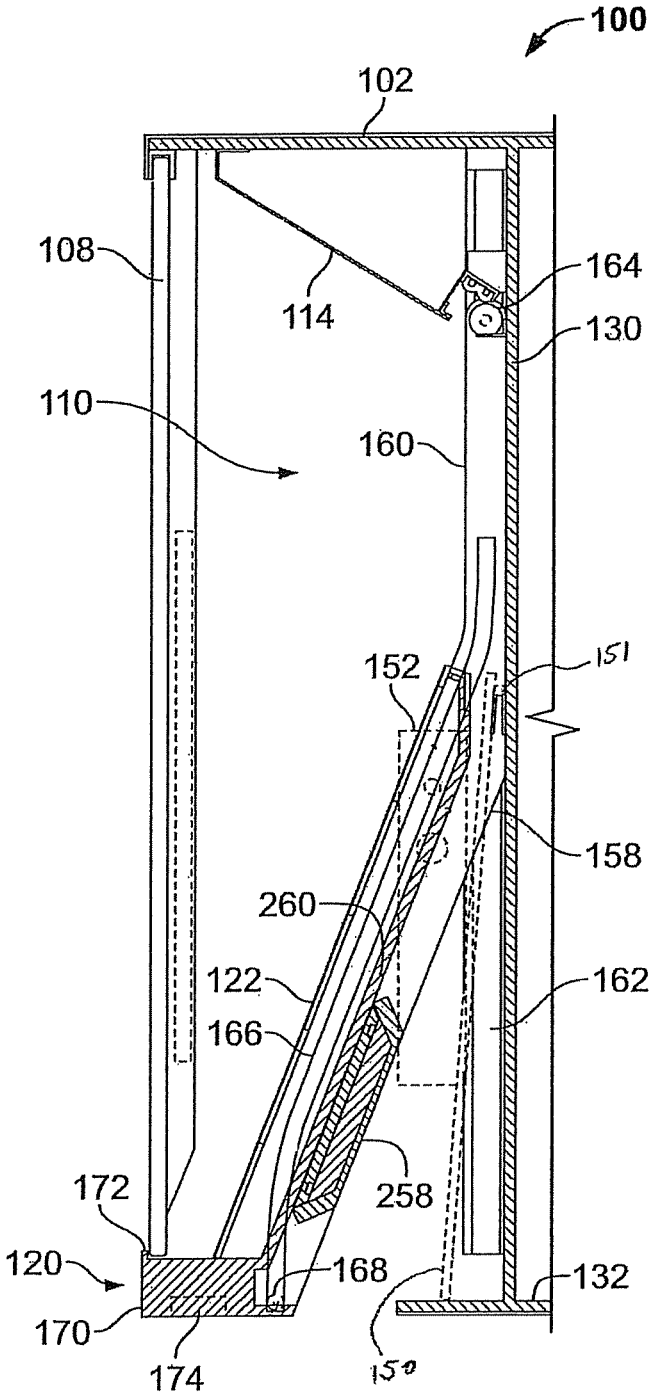
FIG. 6 is a side cross-sectional view of the display area of the display case of FIG. 1, in a closed position.
Figure 7:
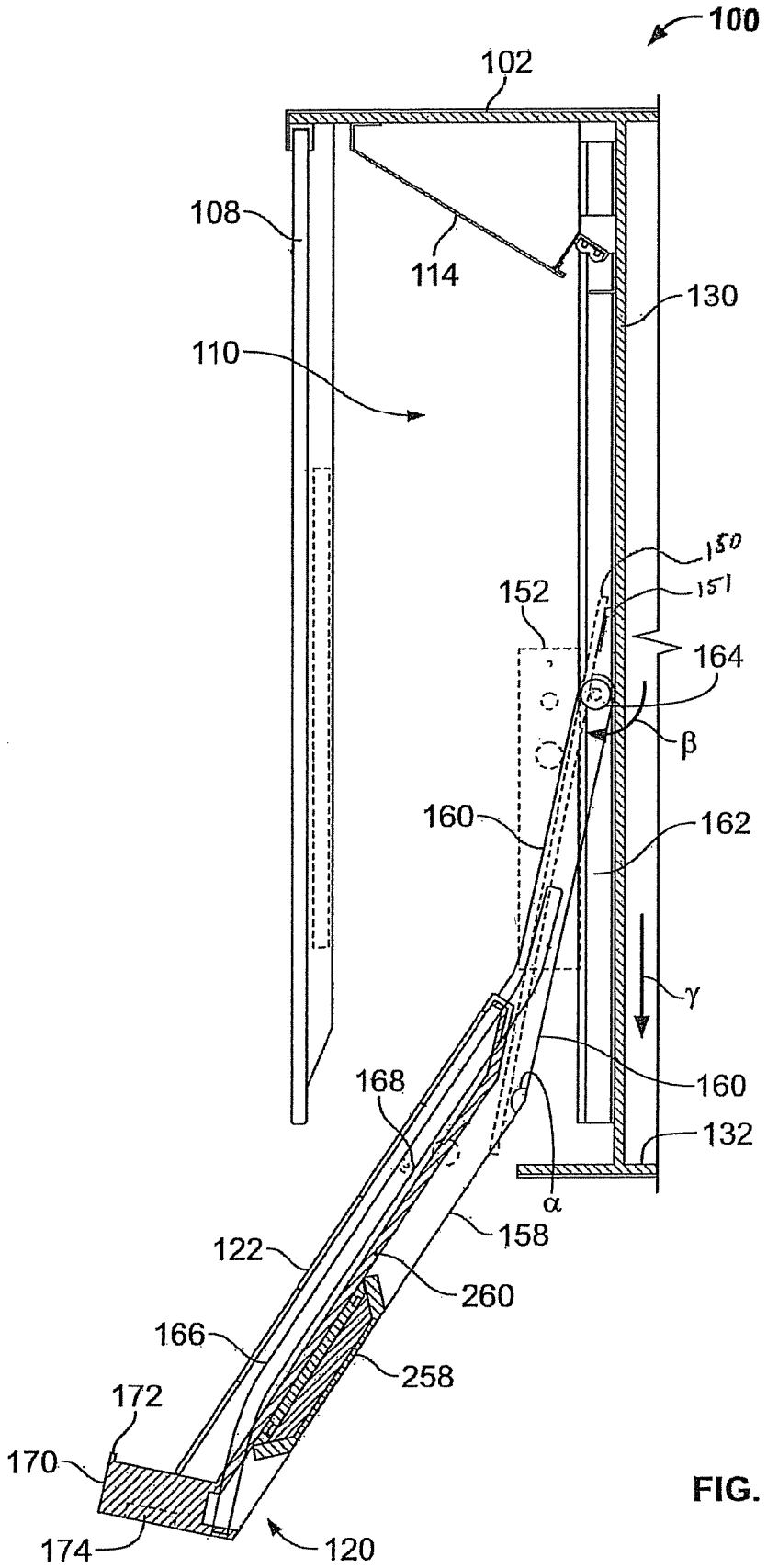
FIG. 7 is a side cross-sectional view of the display area of FIG. 6, in a first intermediate position.
Figure 8:
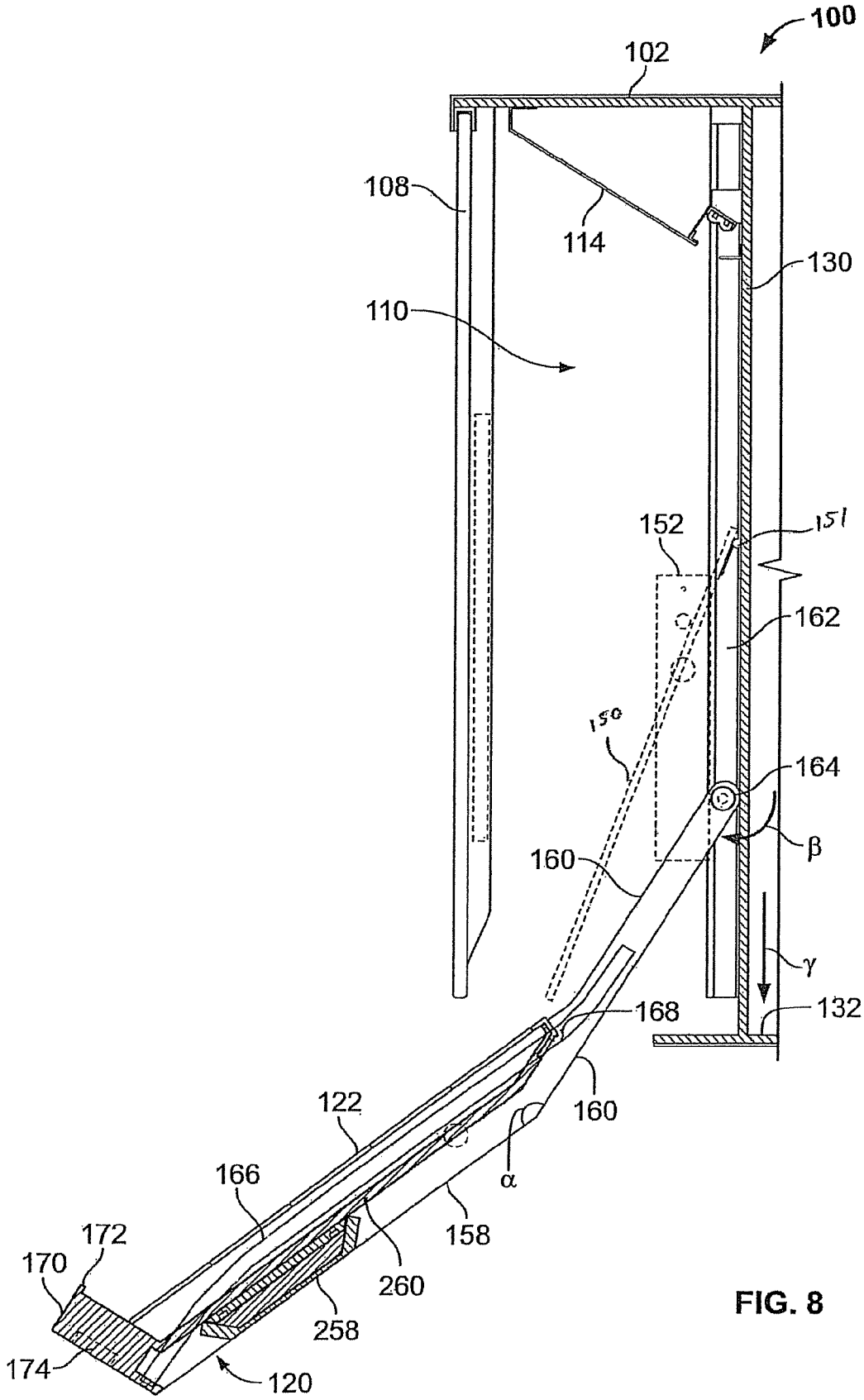
FIG. 8 is a side cross-sectional view of the display area of FIGS. 6-7, in a second intermediate position.

FIGS. 3-5 prove cross-sectional views of some examples of display cases of the present technology. As shown in FIGS. 3 and 4, display cases of the present technology can be single sided, having a display area only at the front of the display case. As shown in FIG. 5, display cases of the present technology can also be double-sided, having a first display area at the front of the display case and a second display area at the rear of the display case. Double-sided display cases can include a first display area 110 as described above, and a second display area 138, which can structurally be substantially identical to, or a mirror image of, the first display area 110. For example, a second display area 138 can be enclosed by the frame of the display case 100, and can be visible through a rear viewing pane 136. A second display drawer 140 can be slidably connected to the frame of the display case 100, and can for example be connected to the sidewalls 104 and 106. The second display drawer 140 can have a closed position and an open position, wherein the second display drawer is enclosed within the second display area in the closed position and is extended beneath the second display area in the open position, as illustrated in FIG. 9 with respect to display drawer 120.

Display cases of the present technology can be mounted on any suitable type of vertical support, such as a wall, a pillar, or one or more rods 124 as shown in FIGS. 3-5. Display cases of the present technology can be mounted at any suitable height, including for example at a height that places the viewing area 110 of the display case in line with the head and chest of a consumer 126 viewing merchandise 128 displayed on the first display drawer 120. In one example, the display case 100 can be mounted such that the top 102 of the case is at a height that is from about 5 feet to about 7 feet.

In order to provide additional structural support, the frame of the display cases of the present technology can include a center wall 130 and base plate 132 attached to the center wall 130. The center wall 130 can be attached to the top 102 of the display case 100, preferably mid-way between the front viewing pane 108 and the rear wall 134 as shown in FIGS. 3-4, or rear viewing pane 136 as shown in FIG. 5. The base plate 132 can provide a horizontal structure that can be used for mounting purposes. For example, a vertical support such as one or more rods 124 can be secured to the top 102 and the base plate 132 of the display case 100 by welding or by at least one fastener 142. Base plate 132 can extend horizontally froth the center wall 130 a distance that does not interfere with the movement of any display drawer from a closed position to an open position. In the example shown in FIGS. 3 and 5, the base plate 132 extends horizontally from the center wall 130 a distance that is only a portion, of the distance to the front viewing pane 108 and the rear wall 134 or rear viewing pane 136. In the example shown in FIG. 4, the base plate 132 extends horizontally from the center wall 130 a distance that is only a portion of the distance to the front viewing pane 108, but that is the entire distance to the rear wall 134.

Referring to FIG. 3, display cases of the present technology can include lighting, including for example at least one side light 144, which can be attached to left side wall 104, or right sidewall 106, or both. Each side light 144 can be configured to shine light into the display area 110, and onto the merchandise 128 displayed on the display drawer 120. Each side light 144 can preferably be activated by a switch activated by the movement of the display drawer 120 into and out of its closed position, such that the side light 144 turns on when the display drawer 120 is in the closed position, and shuts off when the display drawer is moved out of its closed position. Display cases of the present technology can also include additional internal lighting, such as back light 146, which can be configured to shine light onto back panel 112, providing a desired character or ambiance to the display area 108.

Referring to FIGS. 3, and 6-9, the movement of the display drawers will now be described with reference to first display drawer 120. It should be understood, however, that the structure and functionality can also be applied to any second display drawer of the present technology.

When the first display drawer 120 is in the closed position, a first locking mechanism 152 can be used that locks the first display drawer 120 in the closed position. The locking mechanism 152 can be an electronic locking mechanism, such as an electronic deadbolt. Preferably, the locking mechanism can be unlocked by a key card or other device that can be carried by employees and used to unlock the locking mechanism 152 and allow the first display drawer 120 to be moved from its closed position to its open position. The locking mechanism can include a timer, and can cause the display drawer 120 to relock if it is not opened within a certain amount of time, such as for example, from about 20 seconds to about 1 minute, after being unlocked. In examples of double-sided display cases, a first locking mechanism 152 can lock the first display drawer 120 in its closed position, and a second locking mechanism 152 can lock the second display drawer 120 in its closed position.

Display drawers 120 of the present technology can have a side plate 158 connected to each side of the display face, and a support arm 160 connected to each side plate at an angle $\alpha$ of less than about 180°. Each support arm 160 can be slidably connected to a vertical track 162 secured to the frame of the display case 100, such as being secured to a sidewall 104 or 106 of the display case. A pivot hinge 164 can be used to connect each support arm 160 to the vertical track 162, which can allow the display drawer to pivot upwardly in direction $\beta$ as it moves downwardly in direction $\gamma$. The connection between each support arm 160 and the vertical track can be configured to have sufficient friction to hold the display drawer 120 in place against the gravitational force that would otherwise cause the drawer to drop downwardly once the locking mechanism is released. For example, there can be a bearing that rides in a slot on the vertical track, and through bearing there can a bolt that holds a washer and or pressure plate that exerts pressure on the vertical track to create friction. Additionally, each side plate 158 can include a slide groove 166 that receives a bearing wheel 168 secured to the frame, such as to a sidewall 104 or 106 of the display case 100. Each slide groove 166 can be curved, having a configuration that allows the display drawer 120 to pivot from an inclined position when the display drawer 120 is in the closed position to a horizontal position when the display drawer 120 is in the open position.

Display cases of the present technology can also include a blocking panel 150, such as a mirror, attached to the frame, such as to center wall 130 behind the display drawer 120, such that the blocking panel 150 is not visible when the display drawer 120 is in its closed position. The blocking panel can be secured to the center wall 130 by a spring-loaded hinge 151, and can pivot upwardly when the display drawer 120 is moved to its open position. The blocking panel can block the view into the display case behind the display drawer, keeping hidden the support arms 160 of the display drawer 120 and the vertical track 162. When the blocking panel 150 is a mirror, the blocking panel can also provide a viewing surface upon which a customer can view themselves, such as when trying on merchandise that was displayed in the display drawer 120. The display drawer 120 can include at least one contact point with the blocking panel 150, in order to cause the blocking panel 150 to pivot upwardly slowly as the display drawer 120 moves from its closed position to its open position, as well as to pivot the blocking panel back downwardly as the display drawer 120 is moved form its open position to its closed position.

The display drawer 120 can also include a gripping base 170, by which the display drawer can be gripped by an employee to exert force and move the display drawer from its closed position to its open position. The gripping base 170 can serve as a bottom frame piece around the front viewing pane 108 when the display drawer 120 is in its closed position, and the top 102 and sidewalls 104, 106 can include top and side frame pieces, respectively, to create a full frame around the front viewing pane 108. The gripping base 170 can include a top lip 172 that extends upwardly from the gripping base 170 towards the front viewing pane 108 when the display drawer 120 is in its closed position. The gripping base 170 can also include a handle 174, which can be an indentation or other suitable structure to facilitate an employee being able to take hold of the gripping base 170.

In order to provide flexibility for displaying merchandise, the display drawers in display cases of the present technology can include a modular display panel system that allows display panels having different configurations to be placed and removed interchangeably from the display drawers. For example, the first display drawer 120 can include at least one display panel that removably attaches to the display face 122 of the display drawer 120. The display panels can be sized and configured so that one or more display panels can placed into a display drawer 120 at any given time. In some examples, the first display drawer 120 can include one or a plurality of display panels, and each display panel can removably attach to the display face 122.

For example, FIGS. 10A through 10E illustrate some examples of display panels 176, 178, 180, 182, and 184 that are configured for holding and displaying jewelry. Each display panel can have at least one pull tab 186, which can be gripped to remove a display panel from the display face 122 of a display drawer 120. In some examples, the display face 122 and/or each display panel can include one or more magnets, and each display panel can thus magnetically attach to the display face 122 of the display drawer 120.

The display panel of FIG. 10A is simply a flat panel 176, and merchandise can be draped over, and tucked under, the upper edge 188 of the display panel in order to be displayed. When a plurality of such flat display panels 176 are placed on a display face 122, they can be laid together such that the bottom edge 190 of one flat display panel 176 is adjacent to the top edge 188 of another flat display panel 176.

In other examples, such as those illustrated in FIGS. 10B-10E, and 11-13, display panels can include at least one slot that receives an article of merchandise to be displayed. Merchandise slots have a depth, and can be configured at any suitable angle $\delta$ with respect to a display surface 230 of the display panel, including an angle $\delta$ that is from about 45° to about 90°. Each slot can have a back support 232, and can contain padding 234 to retain and cushion the articles of merchandise. Each display panel can also include a low bottom edge 192 and a high upper edge 194, so that the display panels can be placed in an overlapping fashion, as shown in FIGS. 1-13, with high upper edge 194 of one panel being placed on top of the low bottom edge 192 of another display panel.

Figure 11:
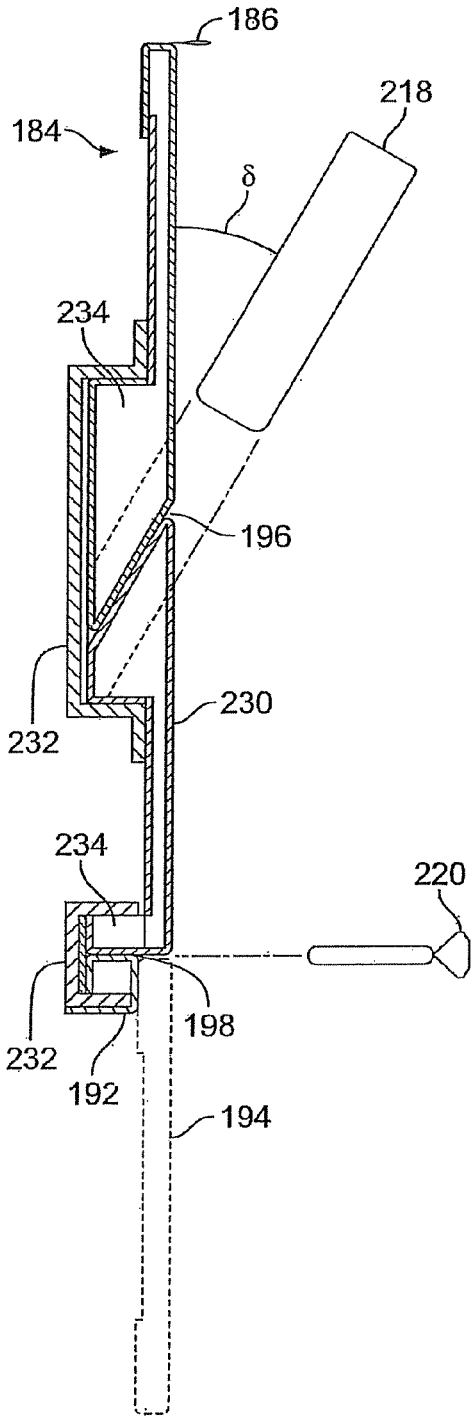
FIG. 11 is a side view of one example of a display panel for bangles for use in a display case of the present technology.

Display panel 184, as shown in FIGS. 10E and 11, includes a first slot 196 that is at an angle of about 45° with respect to the display surface 230 of the display panel 184, and a second slot 198 that is at an angle of about 90° with respect to the display surface 230 of the display panel 184. The first slot 196 can receive a first article of merchandise, such as for example bracelet 218. The second slot 198 can receive a second article of merchandise, such as ring 220.

Figure 12:
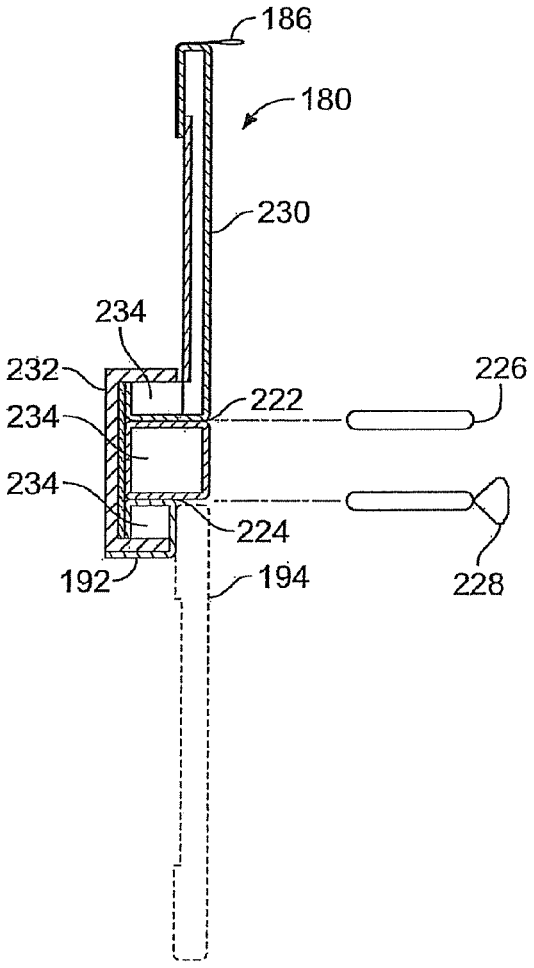
FIG. 12 is a side view of one example of a display panel for ring sets for use in a display case of the present technology.

Display panel 180, as illustrated in FIGS. 10C and 12, includes a first slot 122 that is at an angle of about 90° with respect to the display surface 230 of the display panel 180, and a second slot 224 that is at an angle of about 90° with respect to the display surface 230 of the display panel 180. The first slot 222 can receive a first article of merchandise, such as for example wedding band 226. The second slot 224 can receive a second article of merchandise, such as engagement ring 228.

Figure 13:
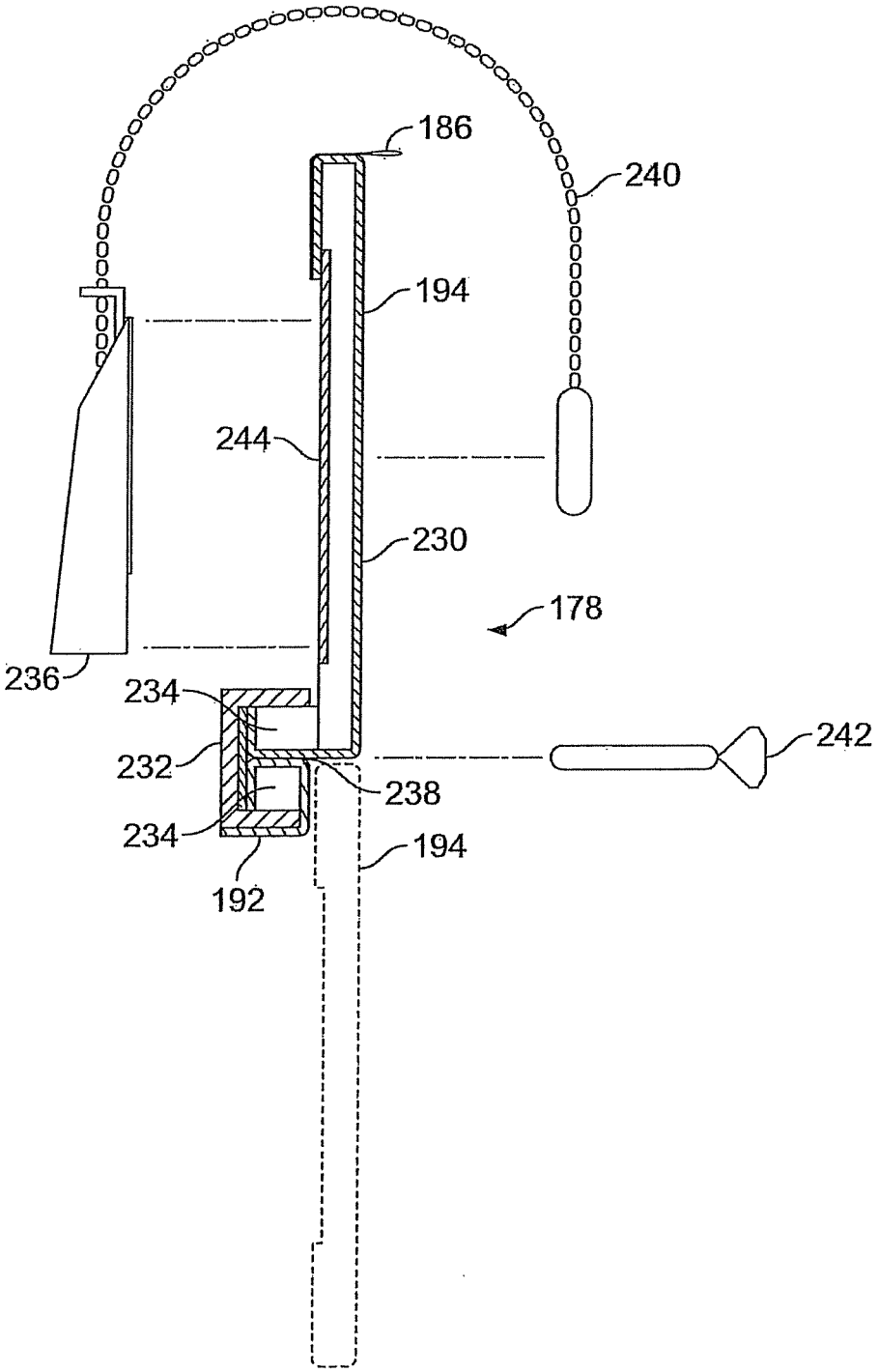
FIG. 13 is a side view of one example of a display panel for rings and necklaces for use in a display case of the present technology.

Display panel 178, as illustrated in FIGS. 10B and 13, includes a chain holder 236 that can be attached to the back side 244 of the display panel 178, and a slot 238 that is at an angle of about 90° with respect to the display surface 230 of the display panel 178. A first article of merchandise, such as necklace 240 can be draped over the upper edge 194 of the display panel 178, and its chain can be received by the chain holder 236. The slot 238 can receive a second article of merchandise, such as for example ring 242.

Figure 14:
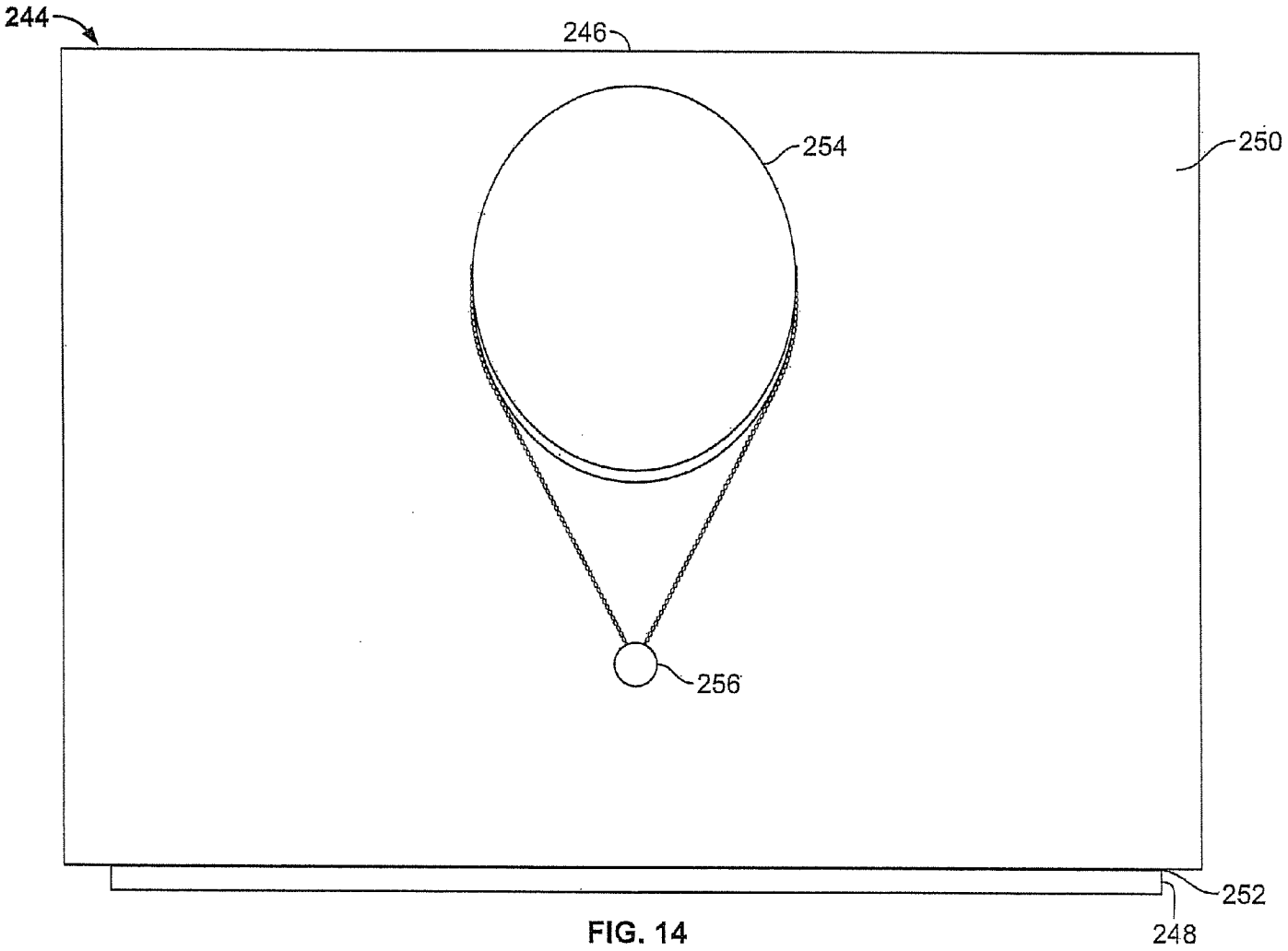
FIG. 14 is a front view of one example of a display panel for necklaces for use in a display case of the present technology.

Another example of a display panel is illustrated in FIG. 14. In this example, the display panel 244 can include a high upper edge 246, a low bottom edge 248, and a display surface 250. The display panel 244 can include a slot 252. The display panel 252 can also include at least one raised feature 254 onto which an article of merchandise, such as necklace 256 can be hung.

Finally, as shown in FIG. 9, in some examples, such as when the merchandise to be displayed is small articles such as jewelry a merchandise gathering tray 258 can be removably attached to an underside 260 of the first display drawer 120. For example, when the underside 260 of the display drawer is steel, or another metal to which magnets are attracted, the merchandise gathering tray 258 can include one or more magnets that create a magnetic attachment to the underside 260 of the first display drawer 120. When the display drawer 120 is opened, the employee can simply reach under the display drawer 120 and remove the merchandise gathering tray 258 in order to conveniently serve a customer.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A display case designed to be mounted on at least one vertical support, the display case comprising:

a frame comprising top and a plurality of sidewalls, the frame housing a first display area, the first display area comprising a back panel, a top panel attached to a top of the frame, a left side panel attached to a left sidewall of the frame, and a right side panel attached to a right sidewall of the frame, wherein the top panel, the left side panel, and the right side panel each slant inwardly from an outer edge of the display case towards the back panel;

a front viewing pane attached to the frame, wherein the first display area enclosed by the frame is visible through the front viewing pane; and a first display drawer slidably connected to the frame, the first display drawer having a closed position and an open position, wherein the first display drawer is enclosed within the first display area in the closed position and is extended beneath the first display area in the open position, the first display drawer comprising:

a display face having a top end and a bottom end, the display face being inclined from a back of the first display area at the top end to a front of the first display area at the bottom end when the first display drawer is in the closed position.

2. The display case of claim 1, further comprising:

a rear viewing pane attached to the frame, wherein a second display area enclosed by the frame is visible through the rear viewing pane; and a second display drawer slidably connected to the frame, the second display drawer having a closed position and an open position, wherein the second display drawer is enclosed within the second display area in the closed position and is extended beneath the second display area in the open position.

3. The display case of claim 2, further comprising a second locking mechanism that locks the second display drawer in the closed position.

4. The display case of claim 1, wherein the display case has a case depth, and the first display area has a depth that is up to about half of the case depth.

5. The display case of claim 1, wherein the display face comprises:

a left side and a right side;

a side plate connected to each side of the display face; and a support arm connected to each side plate at an angle of less than about 180°.

6. The display case of claim 5, wherein each support arm is slidably connected to a vertical track secured to the frame of the display case.

7. The display case of claim 5, wherein each side plate comprises a slide groove that receives a bearing wheel secured to the frame of the display case.

8. The display case of claim 7, wherein each slide groove is curved and allows the display face of the display drawer to pivot from being inclined when the display drawer is in the closed position to a more horizontal position when the display drawer is in the open position.

9. The display case of claim 5, wherein the first display drawer further comprises at least one display panel that removably attaches to the display face.

10. The display case of claim 9, wherein the first display drawer comprises a plurality of display panels and each display panel removably attaches to the display face.

11. The display case of claim 9, wherein the at least one display panel comprises at least one slot that receives an article of merchandise to be displayed.

12. The display case of claim 9, wherein the at least one display panel magnetically attaches to the display face.

13. The display case of claim 1, further comprising:

a merchandise gathering tray removably attached to an underside of the first display drawer.

14. The display case of claim 1, further comprising a first locking mechanism that locks the first display drawer in the closed position.

15. A display case designed to be mounted on at least one vertical support, the display case comprising:

a frame comprising a top and a plurality of sidewalls, the frame housing a first display area;

a front viewing pane attached to the frame, wherein the first display area enclosed by the frame is visible through the front viewing pane; and a first display drawer slidably connected to the frame, the first display drawer having a closed position and an open position, wherein the first display drawer is enclosed within the first display area in the closed position and is extended beneath the first display area in the open position, the first display drawer comprising:

a display face having a left side and a right side;

a side plate connected to each side of the display face; and a support arm connected to each side plate at an angle of less than about 180°;

wherein each side plate comprises a slide groove that receives a bearing wheel secured to the frame of the display case.

16. The display case of claim 15, wherein each support arm is slidably connected to a vertical track secured to the frame of the display case.

17. The display case of claim 15, wherein each slide groove is curved and allows the display face of the display drawer to pivot from an inclined position when the display drawer is in the closed position to a horizontal position when the display drawer is in the open position.

18. The display case of claim 15, wherein the first display drawer further comprises at least one display panel that removably attaches to the display face.

19. The display case of claim 18, wherein the first display drawer comprises a plurality of display panels and each display panel removably attaches to the display face.

20. The display case of claim 18, wherein the at least one display panel comprises at least one slot that receives an article of merchandise to be displayed.

21. The display case of claim 18, wherein the at least one display panel magnetically attaches to the display face.

* * * * *